US011815325B2

(12) United States Patent
Eggert

(10) Patent No.: US 11,815,325 B2
(45) Date of Patent: Nov. 14, 2023

(54) BREECHBLOCK OF A WEAPON SYSTEM AND WEAPON SYSTEM WITH THE BREECHBLOCK

(71) Applicant: Rheinmetall Waffe Munition GmbH, Suedheide (DE)

(72) Inventor: Klaus-Peter Eggert, Zimmern unter der Burg (DE)

(73) Assignee: RHEINMETALL WAFFE MUNITION GMBH, Suedheide (DE)

( * ) Notice: Subject to any disclaimer, the term of this patent is extended or adjusted under 35 U.S.C. 154(b) by 0 days.

(21) Appl. No.: 17/749,956

(22) Filed: May 20, 2022

(65) Prior Publication Data

US 2022/0290935 A1 Sep. 15, 2022

Related U.S. Application Data

(63) Continuation of application No. PCT/EP2020/081126, filed on Nov. 5, 2020.

(30) Foreign Application Priority Data

Nov. 21, 2019 (DE) ..... 10 2019 131 439.9

(51) Int. Cl.
*F41A 7/08* (2006.01)
*F41A 15/14* (2006.01)
*F41A 25/10* (2006.01)

(52) U.S. Cl.
CPC ..... *F41A 7/08* (2013.01); *F41A 15/14* (2013.01); *F41A 25/10* (2013.01)

(58) Field of Classification Search
CPC ..... F41A 25/10; F41A 15/14; F41A 7/08
(Continued)

(56) References Cited

U.S. PATENT DOCUMENTS 4,635,530 A 1/1987 Weldle
4,655,118 A 4/1987 Bruderer et al.
(Continued)

FOREIGN PATENT DOCUMENTS

DE 3712905 A1 11/1988
DE 19903323 A1 8/2000
(Continued)

OTHER PUBLICATIONS

International Search Report dated Mar. 15, 2021 in corresponding application PCT/EP2020/081126.
(Continued)

*Primary Examiner* — John Cooper
(74) *Attorney, Agent, or Firm* — Muncy, Geissler, Olds & Lowe , P.C.

(57) ABSTRACT

A breechblock for a weapon system having a recoilable barrel and having a breechblock carrier and a rotatable breechblock head. The breechblock head is carried by the breechblock carrier. The breechblock carrier has a control cam that is divided into a number of, preferably at least four, cam sections. The actual weapon function and the unlocking of the breechblock or of the breechblock head are combined in this control cam. The breechblock head comprises a control pin, which engages in the control cam and can be guided therein. Attached to the breechblock carrier are two blocking slides, which keep the breechblock head in one of two different positions, in which positions the breechblock head can enter or leave the locking portion of the barrel, namely, a forward position in the course of the actual functioning of the weapon and a rear position during the advancement of the returning masses.

7 Claims, 3 Drawing Sheets

(58) Field of Classification Search
USPC ..... 42/14–19; 89/11, 9
See application file for complete search history.

(56) References Cited

U.S. PATENT DOCUMENTS

| | | | | |
|---|---|---|---|---|
| 4,841,835 | A * | 6/1989 | Bohler | F41A 17/18 89/12 |
| 6,560,908 | B2 | 5/2003 | Murello | |
| 6,625,917 | B2 | 9/2003 | Murello et al. | |
| 8,616,112 | B2 | 12/2013 | Herrmann et al. | |
| 8,745,911 | B2 * | 6/2014 | Zheng | F41A 35/06 42/16 |
| 9,217,615 | B2 * | 12/2015 | Lewis | F41A 3/36 |
| 10,365,054 | B2 | 7/2019 | Schneider | |
| 2005/0011346 | A1 * | 1/2005 | Wolff | F41F 1/10 89/12 |
| 2019/0154382 | A1 | 5/2019 | Pizano | |
| 2022/0146222 | A1 * | 5/2022 | Eggert | F41A 5/32 |
| 2022/0146223 | A1 * | 5/2022 | Eggert | F41A 15/14 |
| 2022/0333882 | A1 * | 10/2022 | Bilgeri | F41A 5/18 |

FOREIGN PATENT DOCUMENTS

| | | | |
|---|---|---|---|
| DE | 19903327 | B4 | 8/2004 |
| DE | 202007010111 | U1 | 11/2007 |
| DE | 102014108469 | A1 | 12/2015 |
| DE | 102019120180 | A1 | 1/2021 |
| DE | 102019120183 | A1 | 1/2021 |
| DE | 102019120184 | A1 | 1/2021 |
| EP | 0114946 | A2 | 8/1984 |
| EP | 0188681 | A1 | 7/1986 |
| EP | 2359085 | B1 | 9/2015 |
| EP | 3155354 | B1 | 12/2019 |
| WO | WO2017009114 | A1 | 1/2017 |

OTHER PUBLICATIONS

International Preliminary Report on Patentability dated Jun. 2, 2022 in corresponding application PCT/EP2020/081126.

* cited by examiner

BREECHBLOCK OF A WEAPON SYSTEM AND WEAPON SYSTEM WITH THE BREECHBLOCK

This nonprovisional application is a continuation of International Application No. PCT/EP2020/081126, which was filed on Nov. 5, 2020, and which claims priority to German Patent Application No. 10 2019 131 439.9, which was filed in Germany on Nov. 21, 2019, and which are both herein incorporated by reference.

BACKGROUND OF THE INVENTION

Field of the Invention

The present invention relates to an unlocking of a breechblock of a weapon system or of a weapon during the return of returning masses of the weapon system. The weapon system can be an automatic weapon, for example. The invention relates in particular to a miniaturization of the recoil unlocking of the breechblock during the return of the returning masses.

Description of the Background Art

Automatic weapons can be basically divided into three categories, into externally powered systems, such as, for example, the Bushmaster III or RMG 7.62, into gas-operated systems, such as, for example, the MK30-2/ABM, and into recoil-operated firearms, such as, for example, the MG3. The latter are also referred to as self-operated systems.

In such weapon systems, a cartridge is brought forward to a breechblock. With the help of the breechblock movement, the cartridge is moved into a weapon barrel or into a cartridge chamber of the weapon barrel. The locking between the breechblock and the barrel takes place in this case via known breechblock systems, such as block lock, sliding block, rotary lug breech, etc.

Externally powered systems have clear advantages for loading management, especially in the provision of different types of ammunition. What all three systems have in common, however, is that the recoil impulse during the firing process must be absorbed by the gun carriage of the systems. In the first two systems mentioned, this energy of the recoil impulse usually remains unused. Only systems in the third category draw upon this energy.

EP 2 359 085 B1, which corresponds to US 2012/0132062, which is incorporated herein by reference, describes a drive with a control cam in the crank housing, wherein the control cam is divided into different sections/sectors in order to set the desired movements of a breechblock as well as the necessary dwell times of the breechblock. The drive in this case is an external drive.

WO 2017/009114 A1, which corresponds to US 2018/0128564, which is herein incorporated by reference, discloses a weapon drive or breechblock drive for externally driven weapons. The drive has a drive cam in which a connecting rod unit is guided. The drive cam defines the firing cycle of the weapon and thus the dwell times of the breechblock. In the front position (as seen in the firing direction), the breechblock is deactivated and locked. After a shot has been fired, the breechblock is unlocked as part of the weapon function and transferred into its rear position; the empty cartridge case is removed from the gun barrel and ejected from the weapon or weapon system. In the rear position, the breechblock is deactivated again and new ammunition is inserted into the weapon and provided to the breechblock. By means of the breechblock drive, the new ammunition is inserted into the barrel and the breechblock is locked again to the barrel. During the times when the breechblock is at rest in the weapon system or is deactivated, the breechblock drive or the connecting rod continues to run.

In general, each drive must be designed for the peak demand in the firing cycle (cadence). Especially with externally powered systems, practice has shown that empty cartridge cases are not reliably extracted by the existing drive. In particular, chain drives as external drives have the problem that when the breechblock is unlocked and the empty cartridge case is extracted, large forces act on the drive chain and the extraction forces must be applied by the drive or the chain. In the individual case, an unextracted cartridge case can mean that the mission is aborted. The empty cartridge case must then be ejected manually (with a cleaning rod). It cannot be ruled out that this may require leaving the protected area of a vehicle in combat.

SUMMARY OF THE INVENTION

The present invention therefore has the object of preventing these problems.

An approach to solving this problem could be to strengthen the drive so that it can also extract highly deformed cartridge cases. However, this approach would result in a larger construction volume, additional weight, and higher costs.

The invention, in contrast, is based on the idea of minimizing the forces acting on the breechblock drive when unlocking the breechblock and extracting the cartridge case by having the breechblock and barrel take over the unlocking and extracting of a cartridge case, independently of the breechblock drive. In this way, the forces otherwise acting on the breechblock drive are reduced or even eliminated, in particular in the case of an external drive (e.g., a chain), when the breechblock is unlocked and the cartridge case is removed.

DE 10 2019 120 180.2, which is incorporated herein by reference, shows an example of a recoil unlocking of a breechblock during the return of the returning or moving masses. Due to an appropriate design, the breechblock or a breechblock head of the breechblock is unlocked from the barrel during the return of the returning masses of the weapon. When the returning masses are advanced, a cartridge case located in the cartridge chamber of the weapon is released from the cartridge chamber. Complete removal of the cartridge case from the barrel then takes place when the breechblock is moved via the breechblock drive as part of its actual weapon function.

DE 10 2019 120 183.7, which corresponds to US 2022/0146222, which is incorporated herein by reference, also takes up the idea of using recoil. The actual unlocking of the breechblock and the removal of the cartridge case take place during the forward motion of the returning mass after the return. The unlocking of the breechblock and the removal of the cartridge case thus take place initially during the forward motion or the advancement of the returning (moving) mass. Once a shot has been fired and the recoil has set in, the breechblock head locked to the barrel, together with the breechblock carrier and barrel, travel back as part of the returning masses. After reversal of the weapon recoil, i.e., during the forward motion of the returning masses, the breechblock carrier is held in place as part of the breechblock. For this purpose, means are provided that hold the breechblock carrier and release the breechblock head relative to the breechblock carrier. As a result, the breechblock head locked to the barrel can continue to quickly move forwards with the barrel during the forward motion. At a predetermined further point in time, the breechblock head is held in place via means and the locking between the breechblock head and the chamber sleeve of the barrel is released until the "unlocked" state is reached and the breechblock is unlocked. Holding the breechblock head in place and releasing it from the barrel occur hereby in the simplest manner by means of a control cam in the breechblock carrier and a control pin on the breechblock head. The breechblock head in so doing is guided along the control cam, as a result of which the breechblock head is caused to rotate in the breechblock carrier. With this rotating movement, the breechblock head is released from the barrel. The breechblock head itself is held in place during this phase.

DE 10 2019 120 184.5, which corresponds to US 2022/0146223, which is incorporated herein by reference, proposes inserting a control sleeve with a control cam into a breechblock carrier of a breechblock. A breechblock head can have a pin that can engage and be guided in this control cam. The control sleeve holds the breechblock head via the pin. A slide enables the release of the mechanical connection between the breechblock head and the breechblock carrier in the event of a backward movement of the returning masses. During the advance of the returning masses, to unlock the breechblock and extract the cartridge case, a rigid mechanical connection is made between the control sleeve and the breechblock carrier in the firing direction. In this case, the breechblock head is held by the control sleeve during the forward movement of the returning masses, as a result of which a mechanical connection can be made between the breechblock head and the breechblock carrier. This can be achieved by blocking the control sleeve and/or blocking the ability of the breechblock head to rotate. The control sleeve is provided with a catch. This catch is preferably attached to the side of the control sleeve and, for example, in the form of a toothed rack. This catch is engaged by a locking slide mounted on the breechblock carrier side. The locking slide is ineffective during the recoil of the weapon, because it is extended. During the advance of the returning masses, the locking slide blocks the control sleeve and holds it. The breechblock head continues to quickly move forward in the control cam of the control sleeve and rotates within it. As a result, the locking between the breechblock head and the barrel or chamber sleeve is released. The breechblock head is held by the control cam of the control sleeve and captured by it. The barrel moves quickly further forward in the firing direction, so that a cartridge case hanging on the breechblock head is pulled out of the barrel at least to some extent.

The present invention also addresses this idea. Here as well, the task of unlocking the breechblock and the task of extracting the cartridge are transferred to the breechblock and the barrel. In implementing the idea, the recoil of the weapon (weapon recoil) after the shot is used to unlock the breechblock from the barrel and to remove the cartridge case; i.e., the unlocking and removal of a cartridge case are realized using the recoil and thus the returning masses of a weapon.

As is known, recoil is initiated when a shot is fired, wherein the returning masses of the weapon, usually the barrel and the breechblock, are accelerated opposite to the firing direction. At the end of the return, part of the recoil energy is stored in the recoil springs of a return mechanism or the like. With this energy the returning masses are moved forward again when these are in the advancing position. Taking advantage of this fact, shortcomings and problems, especially of an external drive, can be circumvented.

At the end of the return of the returning masses, the breechblock is unlocked. The cartridge case, in turn, is released from a cartridge chamber during the advance of the returning masses and is pulled out by a few millimeters. Thus, during the return of the returning masses, the unlocking of the breechblock and, during the forward travel of the returning masses, the extraction of the empty cartridge case take place due to the existing recoil impulse. The unlocking the breechblock and extracting of the empty cartridge case occur independently of the weapon drive. The large power requirement for unlocking the breechblock and for extracting the empty cartridge case to overcome extraction resistance is supplied entirely by the recoil impulse. The weapon drive only performs the weapon functions, such as the back and forth movement of the breechblock, for ejecting the empty cartridge case and feeding a new cartridge. Occasionally or as appropriate, the weapon drive may also be used to drive a feeder.

An automatic weapon having firing control is known from DE 37 12 905 A1, which is incorporated herein by reference. The breechblock includes an upper breechblock part and a carriage, which are each arranged separately and longitudinally displaceable in the weapon housing and can be coupled to one another in a positively locking manner via connecting means. In the event of a cartridge malfunction, the decoupled upper breechblock part remains in the locking position, while all other weapon functions or movements are not braked but continue to run. In this regard, a gas-pressure-controlled decoupling of the upper breechblock part from the carriage is provided.

EP 3 155 354 B1, which is incorporated herein by reference, discloses a breechblock with a striking mechanism and a firing pin safety. A breechblock carrier of the breechblock has a locking cam for locking a breechblock head to a barrel of the weapon, in which a locking pin is guided, which initiates and effects the locking of the breechblock head by turning the breechblock head in the breechblock carrier. The striking mechanism is tensioned by the breechblock when the breechblock is retracted. The firing pin safety and thus the firing pin are only released when the breechblock has locked securely in its forward position. If there was no secure locking, the firing pin is locked so that the sear of the striking mechanism can hit the firing pin but cannot move it in the locked position.

DE 20 2007 010 111 U1 describes a breechblock lock. In this case, the pivotable lock is inserted into the breechblock carrier between a breechblock head and a breechblock carrier. The lock is used to block the movements necessary for locking the breechblock head when the breechblock carrier is moved back. In the locking area, this blocking is removed so that a rotary movement can be executed.

In the example embodiment, the breechblock of the present invention is formed by a breechblock head and a breechblock carrier. The breechblock carrier carries the breechblock head. The breechblock carrier has a control cam in which a control pin of breechblock head can be guided. The actual weapon function and the unlocking of the breechblock or breechblock head are combined in this control cam during the recoil of the weapon. This combination enables miniaturization of the recoil unlocking. The basic idea of the invention is to extend the control cam of the breechblock and to introduce at least one additional locking position between the breechblock head and the breechblock carrier. This can preferably be realized in the form of a blocking position of the breechblock head on the breechblock carrier. During the weapon recoil, i.e., the return of the returning (moving) masses, there is thus a mechanical separation between the breechblock head and the breechblock carrier. This separation is restored during the advance of the returning masses.

The control cam can be preferably divided into four sections. The first two sections, viewed in the firing direction, are used for the actual weapon function, i.e., locking the breechblock or breechblock head to a barrel or chamber sleeve. A third section enables the breechblock head to be unlocked during the return of the returning masses after a shot has been fired, while the breechblock carrier continues to be stationary. A fourth section creates the possibility for the breechblock head to move further (freely) in relation to the breechblock carrier against the firing direction. During the advance of the moving masses, the breechblock head is captured or locked in this position in the area of the front end of this fourth section, as seen in the firing direction.

The breechblock, i.e., the breechblock head, carried by the breechblock carrier, and the breechblock carrier, can be guided by the breechblock drive to its (a) rear position within the weapon as part of the actual weapon function. In this position, a new cartridge can be provided to the breechblock or breechblock head.

It is provided that while the breechblock carrier is moved to an ejector and loading position, the blocking position of the breechblock head is released. This task can be achieved in a simple manner by means of a slide (blocking or locking slide) on or of the breechblock head. The breechblock head can then be pushed along the control cam into a front "open position" in the first cam section. In this position, a further slide (blocking or locking slide) of the breechblock head can then lock with the breechblock carrier, preferably axially.

A new cartridge or ammunition is provided to the breechblock or breechblock head in the loading position. The breechblock and cartridge are transported in the firing direction by means of the breechblock drive. The breechblock is locked to the barrel or a chamber sleeve in a known manner via the first two sections of the control cam and the breechblock drive.

The breechblock, like the drive, can be accommodated in a housing. In this regard, this can be a part of a weapon housing. Alternatively, the housing can be designed such that it forms a module. As a result, the breechblock and the drive can be removed from the weapon housing in a simple manner. Modular designs of this kind are often preferred.

The breechblock carrier can be preferably designed such that it can be guided in the weapon system and/or in the housing. Lateral longitudinal holes along the entire length of the breechblock carrier lend themselves as guides to accommodate guide rods of the weapon system and/or the housing. Alternatively, the breechblock carrier can have on the side some type of rail, etc., that can engage guides in the weapon system and/or housing. A combination of both variants is also conceivable.

An external drive is preferably suitable as a weapon drive. Other drives are also conceivable.

It is achieved by the proposed design that empty cartridge cases are safely extracted in every case. This is accompanied by a further advantage in that weapon malfunctions due to jammed cartridge cases can be ruled out. The external energy share can also be reduced to the requirement for pure loading management. The power of the external drive only has to be adjusted to the loading management. This results in a small construction volume and a lower mass of the overall weapon. The safety of the weapon is not further affected. Unlocking in the event of a firing failure is ruled out, because the recoil impulse is then known to be absent. Unlocking the breechblock in such a case is therefore not possible due to the lack of weapon recoil.

Proposed is a breechblock for a weapon system formed at least by a breechblock carrier and a breechblock head. The breechblock head is carried by the breechblock carrier. The breechblock carrier has a control cam. The control cam is divided into a number of, preferably at least four, cam sections. The actual weapon function and the unlocking of the breechblock or breechblock head as well as the partial and subsequent complete extraction of the cartridge case are combined in this integrated control cam. The breechblock head comprises a control pin, which engages in the control cam. The control pin can be guided in this control cam. The control cam allows free movement of the breechblock head relative to the breechblock carrier. Two slides (blocking or locking slides) are attached to the breechblock head. One slide is used to hold (engage) the breechblock head in its "open" position within the scope of the actual weapon function. The further slide has the task of locking the breechblock head in a rear "open" position in the advancing of the returning masses. The breechblock carrier has at least one, preferably two, guide(s) and/or guide hole(s) on the side for transport within the weapon system.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
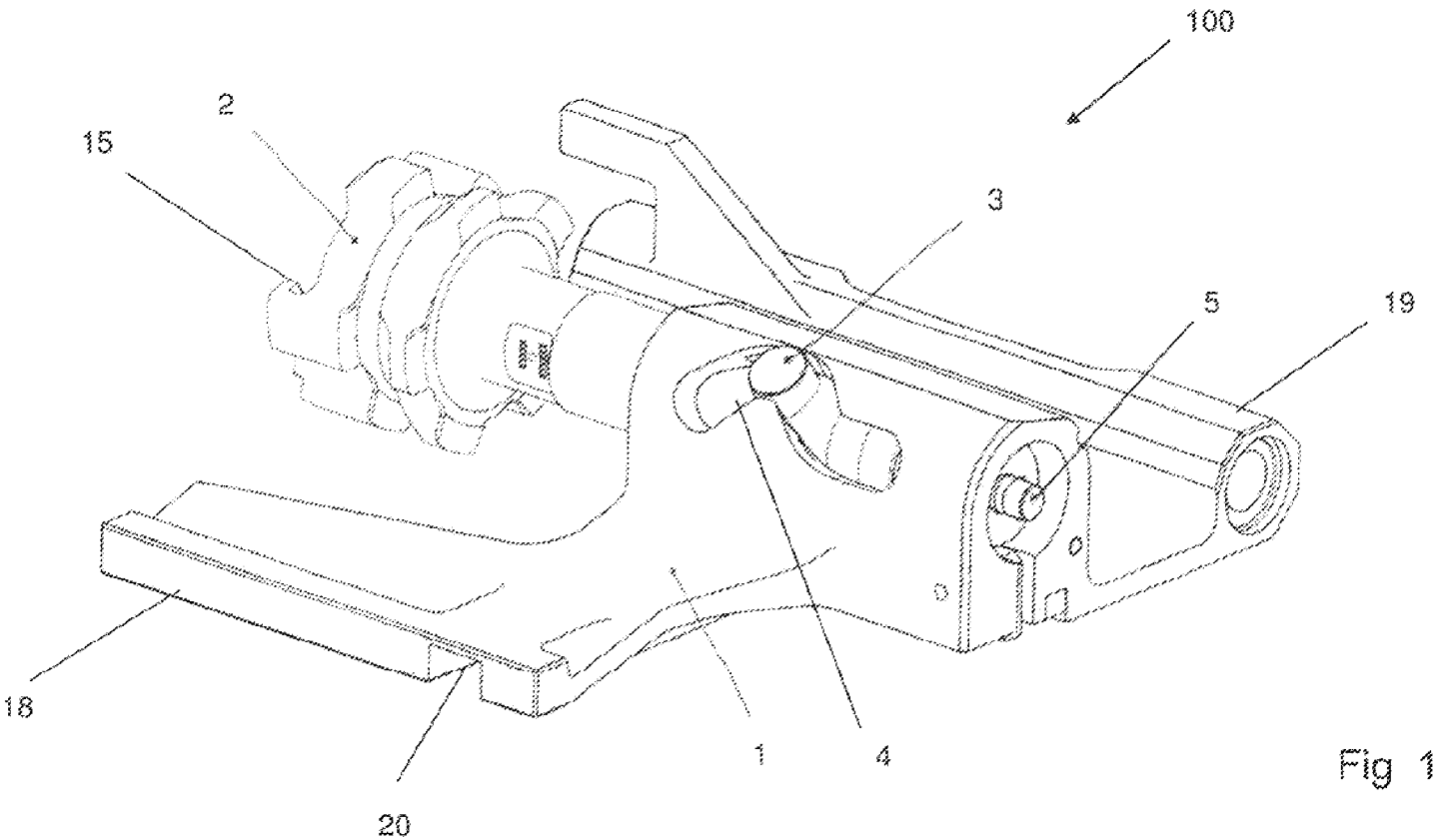
FIG. 1 shows a breechblock of the invention seen in perspective in the firing direction.

A breechblock 100 is shown in FIG. 1. Breechblock 100 is formed from at least one breechblock carrier 1 and a breechblock head 2. Breechblock head 2 is carried by breechblock carrier 1. Breechblock head 2 has a control pin 3. Control pin 3 is attached at the periphery of breechblock head 2. Breechblock carrier 1 has a control cam 4 in which control pin 3 can be guided.

Control cam 4 is divided into preferably four cam sections 4.1-4.4. A front first cam section 4.1, seen in the firing direction, represents the locking of breechblock head 2 with a barrel (not shown in more detail). This locking is completed when control pin 3 enters a second cam section 4.2. Both cam sections 4.1, 4.2 are associated with the actual weapon function. Part of the second cam section 4.2 and two subsequent cam sections 4.3, 4.4 serve the purpose of weapon recoil, in particular the return of the returning (moving) masses as well as the advance of the moving masses up to the advance of the moving masses without breechblock head 2.

A firing pin 5 is inserted in breechblock head 2 and is preferably held in a sleeve (not shown in more detail). Firing pin 3 in breechblock head 2 can be tensioned by a slide 6 via a ring 7. For this purpose, a firing pin spring, for example, which is not shown in more detail, is placed around firing pin 3.

Two so-called blocking or locking slides 8, 9 are attached to breechblock head 2. Breechblock head 2 can be held in its "open position" within the scope of the actual weapon function with blocking slide 8. Blocking slide 9 serves to ensure that, during the advance of the returning masses, breechblock head 2 can be locked or held in the rear "open position" (detent point 16, FIG. 2).

Blocking slide 8 and blocking slide 9 retain their end positions with the aid of at least one bar 10 and at least one guide pin 11. This bar 10 and guide pin 11 limit the stroke of the two locking slides 8, 9. Bar 10 can be secured in breechblock carrier 1 by means of cylindrical screws, etc. Compression springs (not shown in more detail) hold blocking slides 8 and 9 in their upper end position. A tension pin 12 secures guide pin 11 in breechblock carrier 1, and a further tension pin 13 secures the sleeve (not shown in more detail) in breechblock head 2.

Figure 2:
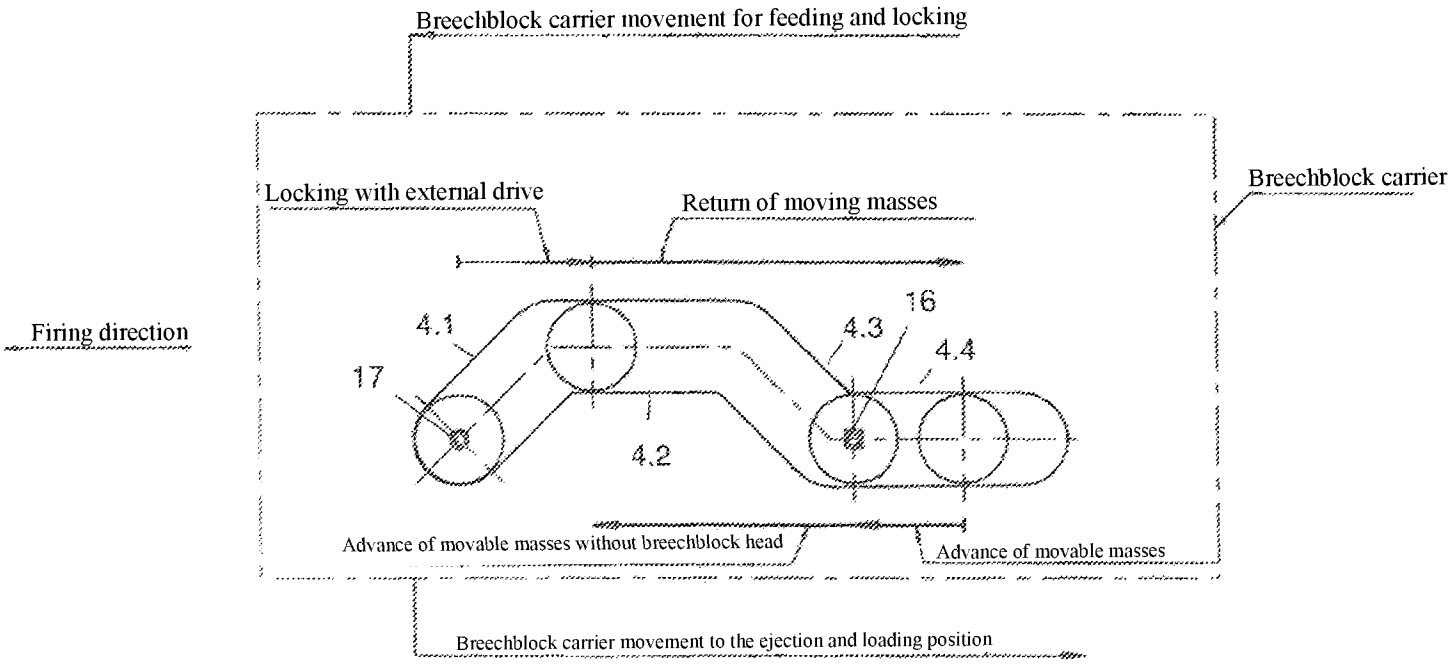
FIG. 2 shows a representation of a control cam in the breechblock carrier from FIG. 1.
Figure 4:
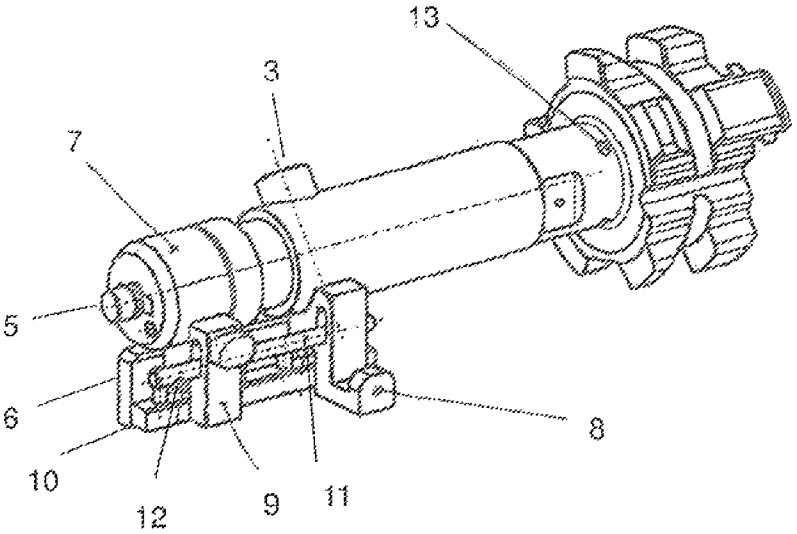
FIG. 4 shows a further perspective representation of the breechblock head according to FIG. 3.
Figure 3:
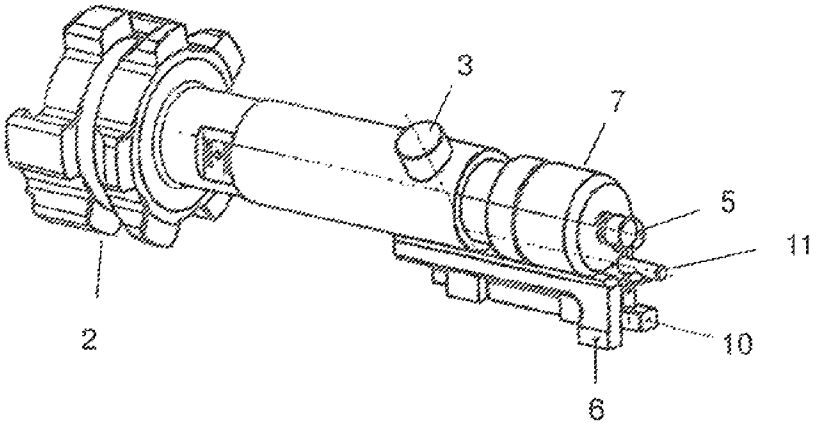
FIG. 3 shows a perspective representation of the breechblock head from FIG. 1.

The unlocking of breechblock 100 or of breechblock head 2 as well as the extraction of a cartridge case (not shown in more detail) will be considered in more detail with reference to FIG. 2:

At the time of firing, control pin 3 is in the second cam section 4.2 of control cam 4. Breechblock 100 is locked. When the shot has been fired, the returning masses are moved against the firing direction. Control pin 3 runs along cam section 4.2. During this time, breechblock head 2 and the locked barrel run opposite to the firing direction. As the returning masses continue to move, i.e., as the moving masses return, control pin 3 is guided along cam section 4.3 of control cam 4. Breechblock head 2 thereby executes a rotary movement. By means of this rotary movement, breechblock head 2 is released from the barrel or a chamber sleeve of the barrel. Breechblock head 2, released from the barrel, and the barrel continue to run together to the rear, against the firing direction and within cam section 4.4 of control cam 4. Blocking slide 9 is ineffective in this case and overruns.

At the end of the return, part of the recoil energy is stored in the recoil springs of a return mechanism or the like (not shown in more detail). The returning masses are moved forward again using this energy, when these are in the advancing position.

As the moving masses advance, blocking slide 9 engages and holds breechblock head 2 in its "open" position. The released barrel, on the other hand, is moved further forward and moves ahead of breechblock head 2. A cartridge case hanging on an extractor claw 15 of breechblock head 2 is partially extracted from the barrel with the cartridge chamber.

The empty cartridge case is then removed during the actual weapon function when breechblock 100 is transferred to its ejector and loading position via a weapon drive or breechblock drive (not shown in more detail). While breechblock carrier 1 is moved to the ejector and loading position, blocking position 16 of breechblock head 2 is released by slide 9 and breechblock head 2 is pushed to the front "open position" 17. In this position, blocking slide 8 on breechblock head 2 can lock breechblock head 2 with breechblock carrier 1, preferably axially.

A new cartridge can be provided to breechblock 100 or breechblock head 2 in the loading position. Breechblock 100 and the cartridge are then transported in the firing direction by means of the breechblock drive. Breechblock 100 is locked to the barrel or a chamber sleeve in a known manner via control cam 4, cam sections 4.1 and 4.2, and the breechblock drive. Here, control pin 3 of breechblock head 2 runs along control cam section 4.1 into control cam section 4.2. Breechblock 100 and the barrel are locked again.

The cycle starts again with the firing.

For transporting breechblock 100 as part of the actual weapon function, breechblock carrier 1 can have lateral guides or guide holes 18, 19. These are matched to guides (not shown further) in the weapon system.

Breechblock carrier 1 may have a groove 20 underneath, in which, for example, a connecting rod (not shown in more detail) of the breechblock drive can engage and be guided similar to WO 2017/009114 A1.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A weapon system comprising:

a weapon barrel that forms part of returning masses; and a breechblock comprising:

a breechblock carrier; and a breechblock head carried by the breechblock carrier, wherein the breechblock carrier has a control cam, wherein the breechblock head comprises a control pin that engages in the control cam and is guided therein, wherein at least one slide is attached to the breechblock carrier and engages with the breechblock head, the at least one slide being a locking slide, wherein the control cam is divided into a plurality of cam sections and comprises at least four cam sections that include a first cam section, a second cam section, a third cam section and a fourth cam section, wherein a part of the second cam section and the third and fourth cam sections are used fora return of the returning masses, and after the return of the returning masses ends, the fourth cam section is used for the advance of the returning masses and the third cam section is used for the advance of the returning masses without the breechblock head, wherein the third cam section enables unlocking of the breechblock head during the return of the returning masses, after a shot has been fired, with the breechblock carrier being fixed, wherein, during the return of the returning masses, an unlocking of the breechblock occurs and during the advance of the returning masses, an extraction of an empty cartridge case occurs via an extractor claw, such that the at least one slide is overrun during the return of the returning masses, and during the advance of the returning masses, the at least one slide engages and holds the breechblock head in a locking position, and wherein, during an operation of the weapon system, the locking position is released by the at least one slide and the breechblock head is pushed into a forward open position associated with the first cam section of the control cam by a weapon drive or breechblock drive.

2. The weapon system according to claim 1, wherein the at least one slide includes two slides that are attached to the breechblock carrier and engage with the breechblock head.

3. The weapon system according to claim 1, wherein the at least one slide is secured to the breechblock carrier by a bar and a guide pin.

4. The weapon system according to claim 1, wherein the breechblock carrier has at least one guide on a side.

5. The weapon system according to claim 1, wherein the breechblock is accommodated in a housing, and wherein the housing is part of a weapon housing or alternatively is formed as a module.

6. The weapon system according to claim 5, wherein the weapon drive or the breechblock drive is arranged in the housing.

7. The weapon system according to claim 1, wherein the weapon drive or the breechblock drive is an external drive.

* * * * *